US005680850A

United States Patent [19]

Buchi

[11] Patent Number: 5,680,850

[45] Date of Patent: Oct. 28, 1997

[54] METHOD AND APPARATUS TO HEAT A BUTTERFLY VALVE NOZZLE

[75] Inventor: Josef Buchi, Lenting, Germany

[73] Assignee: Audi AG, Germany

[21] Appl. No.: 602,338

[22] Filed: Feb. 16, 1996

[30] Foreign Application Priority Data

Feb. 17, 1995 [DE] Germany ..... 195 05 407.5

[51] Int. Cl.[6] ..... F02M 15/04

[52] U.S. Cl. ..... 123/549

[58] Field of Search ..... 123/549, 337, 123/361, 399; 137/487.5, 341

[56] References Cited

U.S. PATENT DOCUMENTS

| | | | |
|---|---|---|---|
| 4,601,271 | 7/1986 | Ejiri et al. | 123/361 |
| 4,698,535 | 10/1987 | Shiraki et al. | 310/156 |
| 4,854,283 | 8/1989 | Kiyono et al. | 123/361 |
| 4,934,341 | 6/1990 | Otsuka et al. | 123/41.31 |
| 5,255,653 | 10/1993 | Ironside et al. | 123/399 |
| 5,261,236 | 11/1993 | Ironside et al. | 60/600 |

FOREIGN PATENT DOCUMENTS

| | | |
|---|---|---|
| 476688 | 9/1965 | Germany . |
| 3743309A1 | 6/1989 | Germany . |
| 4026785A1 | 2/1990 | Germany . |
| 4223933A1 | 1/1994 | Germany . |
| 4228485A1 | 3/1994 | Germany . |
| 4234460A1 | 4/1994 | Germany . |

*Primary Examiner*—Willis R. Wolfe
*Assistant Examiner*—Hieu T. Vo
*Attorney, Agent, or Firm*—Rosenblatt & Redano P.C.

[57] ABSTRACT

An electric motor used to control the butterfly valve in an engine is supplied with increased dissipating energy. The mechanical link between the electric motor and the butterfly valve, preferably combined with favorable heat conductivity of the inlet pipe material in the area of the butterfly valve, facilitates transfer of the electric motor's dissipating heat to the butterfly valve nozzle.

19 Claims, 1 Drawing Sheet

METHOD AND APPARATUS TO HEAT A BUTTERFLY VALVE NOZZLE

FIELD OF THE INVENTION

The field of the invention relates to devices and methods to heat a butterfly valve nozzle located in a combustion engine.

BACKGROUND OF THE INVENTION

To insure proper functioning of butterfly valves in the inlet pipes of combustion engines, inlet pipes and/or butterfly valve nozzles are heated. This is particularly important under weather conditions which may subject the butterfly valve to icing, thus making it impossible to control the air supply. Typically such heating is accomplished by appropriate branching of the vehicle's cooling water circulation system.

It is an object of the present invention to provide a simpler heating method for the inlet pipe in the area of the butterfly valve, allowing heating of the butterfly valve nozzle in the area of the butterfly valve. It is a further object of the invention to eliminate the need for heating by water of the vehicle's cooling water circulation system for combustion engines whose butterfly valves are electronically driven or controlled. In such engines, the gas pedal is fitted with a transmitting unit electrically connected to an evaluation unit. The evaluation unit compares the nominal and actual positions of the butterfly valve and processes other operating parameters of the engine. As a result of such comparison and processing, the butterfly valve is opened or closed using an electric motor. Both the need for mechanical coupling of the electric motor to the butterfly valve and space limitations encourage placement of the electric motor close to the butterfly valve.

SUMMARY OF THE INVENTION

An electric motor used to control the butterfly valve in an engine is supplied with increased dissipating energy. The mechanical link between the electric motor and the butterfly valve, preferably combined with favorable heat conductivity of the inlet pipe material in the area of the butterfly valve, facilitates transfer of the electric motor's dissipating heat to the butterfly valve nozzle.

DETAILED DESCRIPTION OF THE INVENTION

Figure 1:
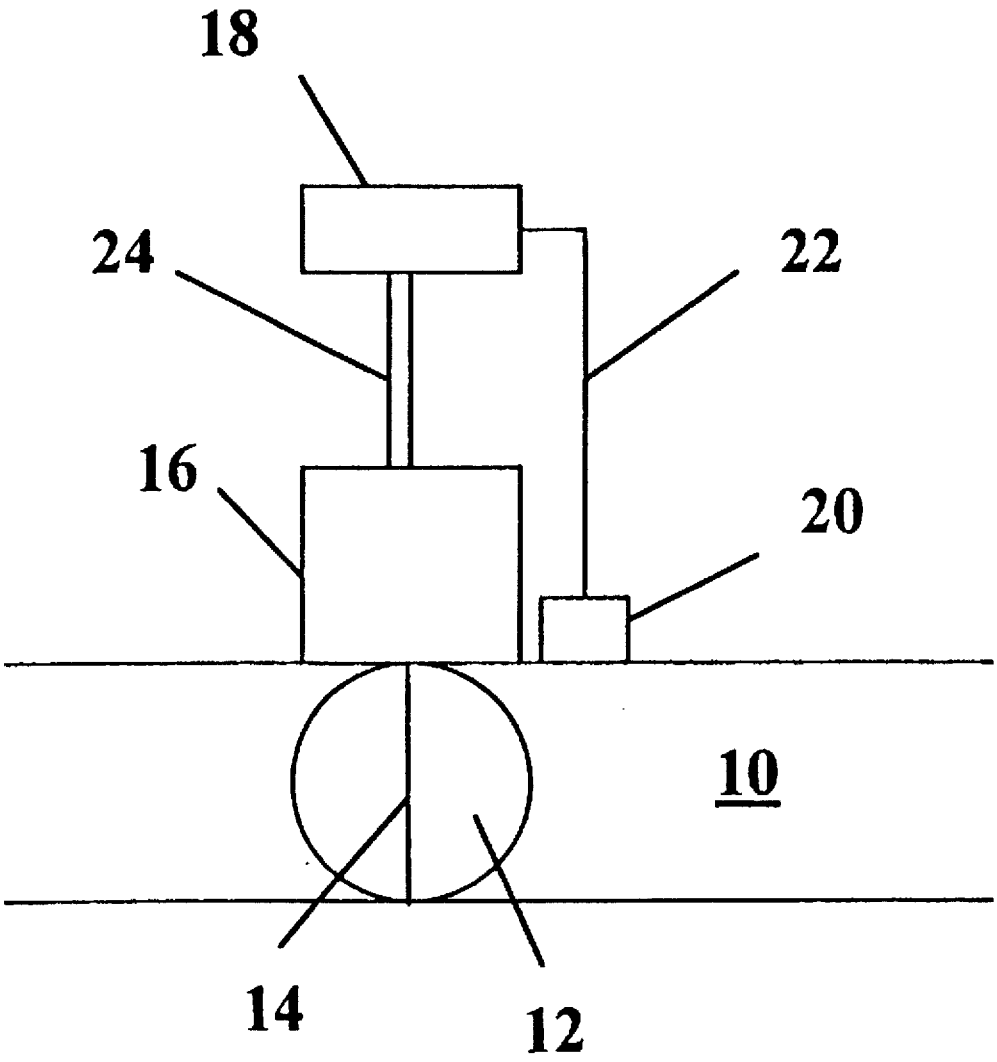
FIG. 1 is a schematic illustration of one possible arrangement of the electric motor with respect to the butterfly valve nozzle in accordance with the present invention.

The dissipating energy supplied to the electric motor controlling a butterfly valve is increased with a corresponding power supply in such a manner that the electric motor heats up. The mechanical link between the electric motor and the butterfly valve transfers the heat. The electric motor is preferably situated adjacent to the inlet pipe area which surrounds the butterfly valve—i.e., the butterfly valve nozzle. The butterfly valve nozzle is generally constructed of aluminum and thus exhibits good heat-conducting properties. Other materials, however, can also exhibit sufficient heat-conducting properties for the purposes of the invention.

The heating of the electric motor can be increased with an impulse sequence producing an alternating current of a frequency sufficient to prevent mechanical activation of the motor due to the actuator inertia. Accordingly, the energy supplied to the electric motor is converted only into heat and not into mechanical energy. At a minimum, the "vibration motions" of the butterfly valve should be maintained at a level that does not affect the combustion phase. The control current for the electric motor is controlled such that the butterfly valve position varies between a minimum and maximum opening angle. The range of the desired opening angle of the butterfly valve is established such that the engine can be operated without producing undesirable effects.

The inlet pipe area is preferably fitted with a temperature-measuring unit to control the dissipating energy supplied to the electric motor.

In contrast with the prior art, where heating of the inlet pipe can only be accomplished after the engine has been running for some time and the cooling water has reached a sufficient temperature, the invention can immediately produce heat with the starting of the engine or even prior to the starting of the engine. The supply of dissipating energy to the electric motor can be achieved immediately and the heating effect requires little time.

The embodiment of the invention illustrated schematically in FIG. 1 shows the butterfly valve nozzle portion of the inlet pipe 10 in which butterfly valve 12 regulates the engine's output by increasing or decreasing the effective cross section of the inlet pipe when rotated about its axis 14. Butterfly valve 12 is rotated using electric motor 16, which is controlled by control unit 18 electrically connected to the motor by wires 24. Control unit 18 receives information concerning, for example, butterfly valve position, operating parameters such as inlet pipe vacuum or engine rotations per minute, and other information beneficial in controlling the butterfly valve.

Heating of the area of the inlet pipe 10 surrounding the butterfly valve 12 is achieved by artificial increase in the heat generated by electric motor 16. Because electric motor 16 is located immediately adjacent to the wall of inlet pipe 10, heat dissipating from electric motor 16 is transferred to the wall of the inlet pipe in the area of the butterfly valve. In addition to drive signals, control unit 18 can provide an impulse sequence to the electric motor to achieve an effective increase in the dissipating heat. The frequency of such impulse sequence is selected such that electric motor 16 can no longer react mechanically. Electric motor 16 therefore does not open or close the butterfly valve 12 in response to such impulse sequence, and preferably causes no vibrating motions in butterfly valve 12. However a pendulum action or vibration in butterfly valve 12 that has no negative effect on engine operation may also produce the desired result.

Temperature sensor 20, which measures the wall temperature of inlet pipe 10 and transfers said value by way of line 22 to control unit 18, is situated sufficiently close to electric motor 16 to reach the area of the inlet pipe 10 in the vicinity of butterfly valve 12. The temperature sensor 20 may include electric properties which change with temperature. Therefore there is no strict need for a separate component since, for example, coil resistance of the electric motor may be used as a temperature measure. Accordingly, control unit 18 may be designed to restrict heating of electric motor 16 to only the required level.

It is also possible to install an engine temperature sensor and/or air temperature sensor to control the dissipating energy supplied to electric motor 16 according to ambient (outside) temperature.

The foregoing disclosure and description of the invention are illustrative and explanatory thereof, and various changes in the size, shape and materials, as well as in the details of the illustrated construction, may be made without departing from the spirit of the invention.

What is claimed is:

1. A method of heating a butterfly valve nozzle in an engine in which the butterfly valve is controlled by an electric motor comprising the steps of:

providing an electric motor with a shaft onto which the butterfly valve is mounted;

providing a control unit electrically connected to said electric motor in order to create dissipating heat without significant rotation of said shaft; and transferring said dissipating heat to the butterfly valve nozzle.

2. The method of claim 1 wherein said electric motor is situated adjacent to said butterfly valve nozzle.

3. The method of claim 1 wherein said dissipating energy of said electric motor is modulated by an impulse sequence to said electric motor.

4. The method of claim 3 wherein said impulse sequence is provided to said electric motor at a frequency which substantially inhibits rotation of said shaft of said electric motor.

5. The method of claim 3 wherein said impulse sequence is provided to said electric motor at a frequency which has an insubstantial affect on the operation of the engine.

6. The method of claim 3 comprising the further step of providing a temperature sensor attached to said butterfly valve nozzle.

7. The method of claim 3 wherein said electric motor also functions as a temperature sensor.

8. The method of claim 1 comprising the further step of providing a temperature sensor to detect ambient temperature, said temperature sensor electrically connected to said control unit.

9. The method of claim 1 wherein said control unit provides said impulse sequence only until said butterfly valve nozzle reaches a predetermined temperature.

10. An apparatus for heating a butterfly valve nozzle in an engine comprising:

a butterfly valve nozzle;

a butterfly valve situated within the butterfly valve nozzle;

an electric motor having a shaft linked to said butterfly valve; and a control unit electrically coupled to said electric motor, said control unit capable of delivering electrical energy to said electric motor at a frequency which generates dissipating energy and substantially inhibits rotation of said shaft of said electric motor.

11. The apparatus of claim 10 wherein said electric motor is adjacent said butterfly valve nozzle.

12. The apparatus of claim 10 wherein said butterfly valve nozzle comprises aluminum.

13. The apparatus of claim 10 further comprising a temperature sensor attached to said butterfly valve nozzle and electrically connected to said control unit.

14. The apparatus of claim 13 wherein said control unit provides said electrical energy to said electric motor in the form of an impulse sequence.

15. The apparatus of claim 13 wherein said control unit provides said electrical energy to said electric motor only until said butterfly valve nozzle reaches a predetermined temperature.

16. The apparatus of claim 10 further comprising a temperature sensor electrically connected to said control unit, said temperature sensor measuring ambient temperature.

17. An apparatus for heating a butterfly valve nozzle in an engine comprising:

a butterfly valve situated within the butterfly valve nozzle;

an electric motor mechanically linked to said butterfly valve; and a control unit electrically coupled to said electric motor; said control unit capable of delivering electrical energy to said electric motor at a frequency which generates dissipating energy and has an insignificant affect on the operation of the engine.

18. The apparatus of claim 17 wherein said electric motor is adjacent said butterfly valve nozzle.

19. The apparatus of claim 17 further comprising a temperature sensor electrically connected to said control unit, said temperature sensor measuring ambient temperature.

* * * * *